United States Patent [19]

Burlison

[11] Patent Number: 4,890,767

[45] Date of Patent: Jan. 2, 1990

[54] HEADBAND SQUIRTER

[75] Inventor: Barry Burlison, Santa Monica, Calif.

[73] Assignee: C & S Distributing Co., Gardena, Calif.

[21] Appl. No.: 191,860

[22] Filed: May 4, 1988

Related U.S. Application Data

[63] Continuation of Ser. No. 20,852, Mar. 2, 1987, abandoned.

[51] Int. Cl.[4] ..... A63H 33/30

[52] U.S. Cl. ..... 222/78; 222/383; 222/192; 351/158; 272/27 N; 446/27; 446/475

[58] Field of Search ..... 222/175, 78, 79, 192, 222/383, 372; 239/284.1, 289, 211; 272/27 W, 27 N, 27 R, 8 N; 446/475, 473, 27; 273/349; 351/158, 155, 156; 2/452, 438, 448, 410, DIG. 11, 426

[56] References Cited

U.S. PATENT DOCUMENTS

| | | | |
|---|---|---|---|
| 1,225,116 | 5/1917 | Dunkelsburg | 2/452 |
| 2,971,196 | 2/1961 | Howell | 2/438 |
| 3,038,483 | 6/1962 | Altsheler | 222/79 |
| 3,214,767 | 11/1965 | Weber | 351/156 X |
| 3,217,928 | 11/1965 | Burbig | 222/175 X |
| 3,231,897 | 2/1966 | Woolfolk, Sr. | 2/438 |
| 3,345,646 | 10/1967 | McCann | 446/27 |
| 3,350,552 | 10/1967 | Lawrence | 351/158 X |
| 3,582,194 | 6/1971 | Liautaud | 2/448 X |
| 3,754,298 | 8/1973 | Menil | 351/158 X |
| 4,058,237 | 11/1977 | Luke | 222/175 X |
| 4,150,681 | 4/1979 | Howarth, Jr. | 239/284.1 |
| 4,214,674 | 7/1980 | Jones et al. | 222/175 X |
| 4,616,367 | 10/1986 | Jean, Jr. et al. | 2/452 |
| 4,712,254 | 12/1987 | Daigle | 2/452 |

FOREIGN PATENT DOCUMENTS

| | | | |
|---|---|---|---|
| 329603 | 11/1920 | Fed. Rep. of Germany | 2/438 |
| 2410586 | 9/1975 | Fed. Rep. of Germany | 351/156 |
| 2109042 | 5/1972 | France | 2/410 |
| 1286783 | 8/1972 | France . | |
| 413447 | 7/1934 | United Kingdom | 2/438 |

OTHER PUBLICATIONS

Illustrated Catalogue, Magic-Puzzles, S. S. Adams Co., Asbury Park, N.J.

*Primary Examiner*—Kevin P. Shaver
*Assistant Examiner*—Stephen B. Parker
*Attorney, Agent, or Firm*—Laff, Whitesel, Conte & Saret

[57] ABSTRACT

A novelty amusement toy comprising a headband mounted water squirting device is disclosed. A hand held water reservoir containing a trigger actuated pump is connected by flexible tubing to a water squirting orifice located on a headband. Actuation of the pump trigger causes water to be forced from the reservoir through the flexible tubing and squirted through the orifice.

5 Claims, 1 Drawing Sheet

HEADBAND SQUIRTER

This application is a continuation of application Ser. No. 020,852 filed Mar. 2, 1987 now abandoned.

BACKGROUND OF THE INVENTION

1. Field of the Invention

The present invention relates to a novelty amusement toy and, more particularly, to a headband mounted water squirter.

2. Background

Water squirting devices are popular amusement toys for children as well as many adults. Typically, these devices are configured to resemble a firearm such as a pistol or automatic weapon. Such devices are widely use to act out imaginary battles.

Other water squirting devices are known for use in performing practical jokes. A common device of this type is an artificial flower which may be worn in a lapel and which is connected by a flexible tube to a concealed squeeze bulb filled with water.

Many fantasy stories are populated with a variety of creatures and superhuman heros. Such characters are frequently depicted as being equipped with exotic weapons. Children acting out such fantasy stories, therefore, require more exotic water squirting devices than those which resemble conventional firearms.

SUMMARY OF THE INVENTION

Accordingly, it is an object of the present invention to provide a water squirting device which resembles an exotic weapon of the type which might be employed by a superhuman hero or villain.

It is another object of the invention to provide a water squirting device which may be worn as a headband.

These and other objects of the present invention are achieved by providing a water squirting device which comprises a hand-held water reservoir having an integral pump. Water is pumped through flexible tubing and is expelled through a water squirting orifice which is located on a band to be worn about the head.

DETAILED DESCRIPTION OF THE PREFERRED EMBODIMENT

Figure 1:
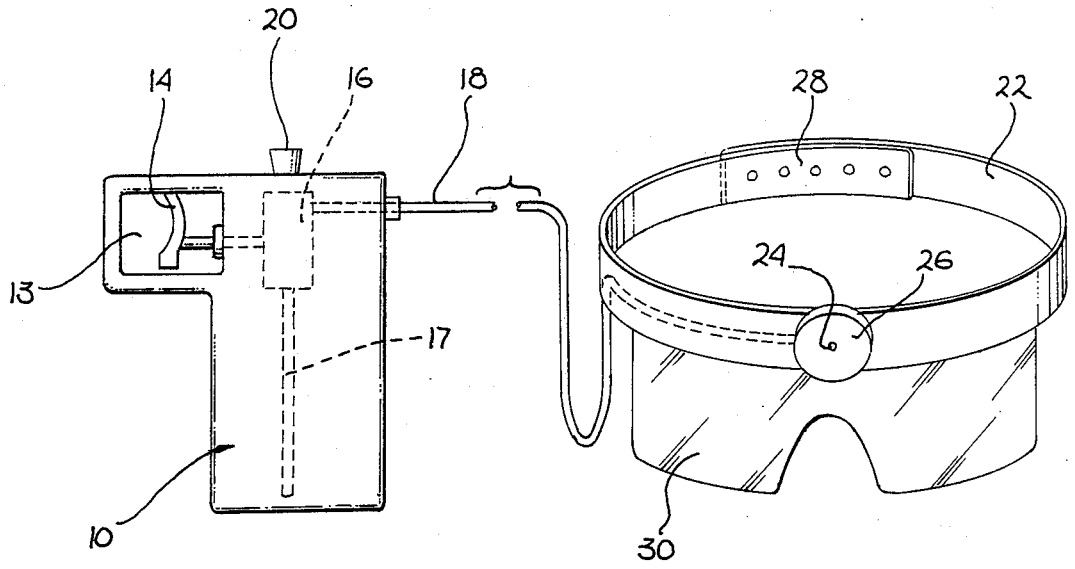
FIG. 1 is a perspective view of the preferred embodiment of the present invention.

In the following description, for purposes of explanation, specific materials and configurations are set forth in order to provide a thorough understanding the present invention. However, it will be apparent to one skilled in the art that the present invention may be practiced without these specific details.

Referring to FIG. 1, reservoir 10 is adapted to be comfortably held in a hand of a user with the forefinger extending though opening 13 for actuation of trigger 14. Reservoir 10 may be filled with water by removing stopper 20. Trigger 14 is connected to pump 16, the detailed construction of which is well known to those skilled in the art of water squirting devices generally. Actuation of trigger 14 causes pump 16 to draw water in through siphon tube 17 and expel it through water tube 18.

Headband 22 is worn about the head of an operator of the present invention. Water tube 18 terminates at tube tip 26 which is disposed at the front of headband 22. Water pumped through water tube 18 is expelled through orifice 24 disposed in tube tip 26. The dimensions of orifice 24 are important to assure proper squirting action. Similar orifices are common to water squirting devices generally and their dimensions are well known to those skilled in the art. Water tube 18 is of sufficient length to permit reservoir 10 to be conveniently carried in the hand of the operator while headband 22 is worn. A length of approximately three feet is generally sufficient. Water tube 18 is preferably secured to the inner surface of headband 22 such that it passes behind the ear of the operator. Adjustment means 28 permits headband 22 to be worn by operators of various head sizes. Adjustment means 28 may comprise one or more male plugs molded onto one end of headband 22 and a plurality of holes on the other end which may be selectively engaged with the male plugs.

Headband 22 may incorporate lens 30 to protect the eyes of the operator from water squirted by a similarly-equipped adversary. Lens 30 may be secured to headband 22 by a suitable adhesive or may be overlapped and heat staked.

The materials of which the components of the present invention are constructed are not critical. It is preferred that trigger 14, pump 16, siphon tube 17, water tube 18, stopper 20 and tube tip 26 be made of a material such as polypropylene. Lens 30 is preferably made of transparent styrene or Lexan (R) which may be clear or tinted to protect the operator's eyes from sunlight. Reservoir 10 may be made of the same material as lens 30 or may be made of a similar opaque material. Headband 22 is preferably made of a moldable flexible material such as vinyl or "skinned" foam in order to readily conform to the shape of the operator's head.

I claim:

1. A water squirting device comprising:

a water reservoir having at least one orifice for expelling water;

a headband for encircling an operator's head, said headband having an orifice for squirting water in a direction away from the operator and approximately parallel to the operator's straight-ahead line of vision;

means for drawing water from said reservoir and expelling it through said reservoir orifice, said means contained within said reservoir;

a flexible water-conducting tube having a first end coupled to said reservoir orifice and a second end coupled to said headband orifice, and wherein a length of said water-conducting tube extends from said headband orifice and along the inside surface of said headband, and means for securing said length of said water-conducting tube to said inside surface of said headband so that when the headband is in position on the operator's head, said length of said tube extends from said headband orifice along the operator's forehead and curves generally toward the operator's ear in a generally horizontal direction, and is thereby out of the operator's line of sight and concealed from those in position to be squirted by water emerging from said headband orifice.

2. The device of claim 1 further comprising lens means attached to said headband for protecting the eyes of the operator.

3. The device of claim 1 wherein the circumference of said headband is adjustable.

4. The water squirting device of claim 1 wherein said means for drawing water is a trigger-actuated pump.

5. The water squirting device of claim 1 wherein said tube is of sufficient length to permit said reservoir to be conveniently carried in the operator's hand and concealed from others while said headband is worn.

* * * * *